US005316850A

United States Patent [19]

Sargent et al.

[11] Patent Number: 5,316,850

[45] Date of Patent: May 31, 1994

[54] PERMANENTLY STAIN RESISTANT TEXTILE FIBERS

[75] Inventors: Ralph R. Sargent; Michael S. Williams, both of Rome, Ga.

[73] Assignee: Peach State Labs, Inc., Rome, Ga.

[21] Appl. No.: 685,480

[22] Filed: Apr. 12, 1991

[51] Int. Cl.[5] ..... D06M 14/04; D06M 14/12

[52] U.S. Cl. ..... 428/378; 8/115.56; 8/115.65; 8/116.1; 428/96; 428/392; 428/393; 428/395

[58] Field of Search ..... 428/96, 375, 378, 392, 428/393, 395; 8/115.56, 115.65, 116.1; 252/8.6; 427/393.4

[56] References Cited

U.S. PATENT DOCUMENTS

| | | | |
|---|---|---|---|
| 3,577,212 | 5/1971 | Jirou et al. | 8/115.58 |
| 3,622,543 | 11/1971 | Garforth . | |
| 3,959,559 | 5/1976 | Kimoto et al. | 428/394 |
| 3,994,990 | 11/1976 | Foote | 525/432 |
| 4,081,383 | 3/1978 | Warburton, Jr., et al. | 252/8.6 |
| 4,082,739 | 4/1978 | Seitz | 534/634 |
| 4,317,859 | 3/1982 | Smith | 428/389 |
| 4,407,848 | 10/1984 | Yamaguchi et al. | 427/36 |
| 4,477,514 | 10/1984 | Gee et al. | 428/264 |
| 4,507,324 | 3/1985 | Olive et al. | 428/375 |
| 4,595,518 | 6/1986 | Raynolds et al. | 252/8.6 |
| 4,596,582 | 6/1986 | Logullo, Sr. | 8/115.6 |
| 4,663,372 | 5/1987 | Okamoto et al. | 524/100 |
| 4,699,812 | 10/1987 | Munk et al. | 427/393.4 |
| 4,822,373 | 4/1989 | Olson et al. | 8/115.6 |
| 4,839,212 | 6/1989 | Blyth et al. | 428/96 |
| 4,865,885 | 9/1989 | Herlant et al. | 427/322 |
| 4,875,901 | 10/1989 | Payet et al. | 8/115.56 |
| 4,886,707 | 12/1989 | Marshall | 428/395 |
| 4,937,123 | 6/1990 | Chang et al. | 428/96 |
| 4,940,757 | 7/1990 | Moss, III, et al. | 525/502 |
| 4,963,409 | 10/1990 | Liss et al. | 428/96 |

FOREIGN PATENT DOCUMENTS

| | | | |
|---|---|---|---|
| 0118983 | 9/1984 | European Pat. Off. . | |
| 0345212 | 12/1989 | European Pat. Off. . | |
| WO91/14512 | 10/1991 | PCT Int'l Appl. | 8/115.65 |

OTHER PUBLICATIONS

*American Dyestuff Reporter* 77(5), 36 (1988).
*Man-Made Fibers*, Fourth Ed. Heywood Books, 1966.
*World Abstract* 312 vol. 8(1) 1976.
*World Textile Abstract* vol. 19(6) 1987/1675.
*World Textile Abstract* vol. 19(6) 1987/1678.
*World Textile Abstract* vol. 15(24) 1983/7783.
*World Textile Abstract* vol. 15(24) 1983/7785.
*World Textile Abstract* vol. 15(20) 1983/6589.
*World Textile Abstract* vol. 15(20) 1983/6590.
*World Textile Abstract* vol. 17 (1) 1985/155.
*Chemical Abstract* 110:156016k vol. 110 (1989).
*Chemical Abstract* 111:8831c vol. 111(2) (1989).
*Chemical Abstract* 105:210361f vol. 105(24) (1986).
*Chemical Abstract* 102:205391z vol. 102(24) (1985).
*Chemical Abstract* 92:95595j vol. 92(2) (1980).
*Chemical Abstract* 98:199765e vol. 98(24) (1983).
*Chemical Abstract* 102:115098e vol. 102(14) (1985).
*Chemical Abstract* 80:97290g vol. 80(18) 1974.
*Chemical Abstract* 107:116954w vol. 107 (1987).
*World Textile Abstract* vol. 9(13) 1977/5207.
*World Textile Abstract* vol. 11 1979/3919.
*World Textile Abstract* vol. 7 1975/1304.
*Chemical Abstract* 112:21868k vol. 112 (1990).

*Primary Examiner*—George F. Lesmes
*Assistant Examiner*—Christopher Brown
*Attorney, Agent, or Firm*—Kilpatrick & Cody

[57] ABSTRACT

Permanently stain resistant nylon and cellulosic fibers, and a method to impart permanent stain resistance to polyamide or cellulosic fibers, by covalently binding a stain resistant composition to a linking compound that has been covalently attached to the fiber are disclosed. This invention represents a significant advance in the art of textile treatments in that the covalently linked stain resist treatment is not removed after a series of alkaline shampooings. This invention is particularly useful in the preparation of commercial grade carpets for heavy traffic areas that will not lose their stain resistance after frequent shampooing.

8 Claims, No Drawings

PERMANENTLY STAIN RESISTANT TEXTILE FIBERS

BACKGROUND OF THE INVENTION

This application relates to a method to impart permanent stain resistance to textile fibers.

Both natural and synthetic fibers are easily stained during normal use. In fact, it has been estimated that more textile fibrous products, including clothing and carpeting, are discarded because they are stained or soiled than because the fibers are worn out.

Staining, as opposed to soiling, typically occurs when an exogenous colored material binds either ionically or covalently to the fiber. The ability of a staining material to bind to a fiber is a function of the type of active functional groups on the fiber and the staining material. For example, nylon fiber consists of polyamide polymers that have terminal carboxyl and (often protonated) terminal amino groups. Common household acid dyes (colored materials with negatively charged active groups), found in a number of materials, for example, wine, red colored soft drinks, and mustard, often form strong ionic bonds with the protonated terminal amine functions of nylon, resulting in discoloration of the nylon fiber.

A number of processes and treatments have been developed to protect nylon fiber from staining materials that attach to the terminal amine functions. The most widely used method involves the application to the polyamide fiber of a colorless aromatic formaldehyde condensation polymer (sometimes referred to below as a "novolac resin") that has sulfonate groups on the aromatic rings. The negatively charged sulfonate groups bind ionically to available protonated amino groups in the polyamide fiber, preventing the protonated amino groups from later binding to common household acid dyes. The polymeric coating also protects the carpet fiber by creating a barrier of negative electric charge at the surface of the fiber that prevents like-charged acid dyes from penetrating the fiber.

Examples of aromatic-formaldehyde condensation polymers are described in a number of patents, including U.S. Pat. No. 4,501,591 to Ucci, et al., and U.S. Pat. Nos. 4,592,940 and 4,680,212 to Blythe, et al (that describe a formaldehyde condensation product formed from a mixture of sulfonated dihydroxydiphenylsulfone and phenylsulphonic acid, wherein at least 40% of the repeating units contain an $-SO_3X$ radical, and at least 40% of the repeating units are dihydroxydiphenylsulfone). U.S. Pat. No. 4,822,373 to Olson, assigned to Minnesota Mining and Manufacturing Company, describes a method for treating nylons for stain resistance, as well as fibrous products produced thereby, that includes treating the fiber with a mixture of a partially sulfonated novolac resin and polymethacrylic acid, copolymer of methacrylic acid, or combination of polymethacrylic acid and copolymers of methacrylic acid. U.S. Pat. No. 4,937,123 to Chang describes and claims a method for imparting stain resistance to nylon fibers that includes contacting the fibrous material with a solution that includes polymethacrylic acid, or a copolymer of methacrylic acid that includes at least 30 weight percent methacrylic acid, or combinations thereof, wherein the lower 90 weight percent has a weight average molecular weight in the range of 2500 to 250,000 and a number average molecular weight in the range of 500 to 20,000, and wherein the treated fibrous substrate has a resistance to staining of at least 5 (when measured against a scale of 1 to 8, with 1 indicative of no stain resistance and 8 indicative of excellent stain resistance).

U.S. Pat. No. 4,940,757 to Moss, et al., and assigned to Peach State Labs, Inc., describes a stain resistant composition for nylon fibers that is prepared by polymerizing an o-substituted acrylic acid in the presence of a novoloid resin.

Sulfonated aromatic formaldehyde condensation products marketed as stain resistant agents include Erional=NW (Ciba-Geigy Limited), Intratex N TM (Crompton & Knowles Corp.), Mesitol=NBS (Mobay Corporation), FX-369 (Minnesota Mining & Mfg. Co.), CB-130 (Grifftex Corp.), and Nylofixan P (Sandoz Chemical Corp.) Antron Stainmaster TM carpet manufactured by Du Pont contains nylon fibers that have both a fluorocarbon coating and a sulfonated phenolformaldehyde condensation polymeric coating.

Cotton fiber is a unicellular, natural fiber composed of almost pure cellulose, a carbohydrate with a large proportion of free hydroxyl groups. Cellulose is also a chief component in rayon (a manufactured fiber composed of regenerated cellulose, in which substituents have replaced not more than 15% of the hydrogens of the hydroxyl groups), acetate (cellulose acetate fibers, in which the hydroxyl groups are partially acetylated), and triacetate (cellulose fibers in which at least 92% of the hydroxyl groups are acetylated). Colored material that can ionically or covalently bind to free hydroxyl groups in the cellulose will easily stain cotton fiber.

While application of stain treatments have improved the resistance of the above-mentioned fibers to certain colored materials, all of the treatments have the distinct disadvantage that they are not permanent because they are bound to the fiber by ionic, and not covalent, bonds. They are removed from the fiber after a number of shampooings. Therefore, after a time period, the fibrous product is just as susceptible to staining as before treatment. This is a very significant problem for commercial grade carpet, that must be cleaned very often.

It is therefore an object of the present invention to provide textile fibers, in particular polyamide and cellulosic fibers, that are permanently stain resistant.

It is another object of the present invention to provide a method to impart permanent stain resistance to textile fibers, and in particular to polyamide and cellulosic fibers.

SUMMARY OF THE INVENTION

Permanently stain resistant fibers are prepared by:

(1) reacting the fiber with a colorless fiber reactive compound of the structure X-A-Y, wherein X is a group that is easily displaced by or reacts with a reactive group on the fiber to form a covalent linkage between A and the fiber, Y is or contains a functional group that will covalently link to, or be displaced by, a stain resistantant composition, and A is an aromatic, heteroaromatic, or aliphatic moiety that optionally contains side groups other than X or Y that may or may not react with the fiber or the stain resist treatment, to form fiber-A-Y; and (2) reacting the fiber-A-Y with a stain resist treatment to form a covalent linkage between a functional group on Y and the stain resist treatment, or between A and the stain resist treatment (by displacing Y).

The stain resistant composition that is covalently bound t the fiber can ionically block remaining "dyeable" locations on the fiber to prevent later staining of the fiber by colored materials.

After the stain resist treatment, the fiber can be coated with a fluorocarbon composition to provide additional resistance to wetting and soiling.

DETAILED DESCRIPTION OF THE INVENTION

As used herein, the term "reactive group" or "functional group" refers to a chemical moiety that is capable of reacting with another moiety to produce a new ionic or covalent chemical species. The term "fiber reactive compound" refers to a compound that will react with a functional group on a fiber to form a covalent linkage with the fiber. The term "fiber reactive dyestuff" or "fiber reactive dye" refers to a type of water-soluble anionic dye capable of forming a covalent bond with nylon or cellulose fibers. The term "stain resistant composition" refers to any compound, including a polymeric compound or composition, that imparts stain resistance to natural or synthetic fibers. The term "polyamide" refers to a polymer with internal amide linkages and terminal amino and carboxyl groups, including but not limited to nylon, silk, wool, and leather. The term "aliphatic" refers to a straight, branched, or cyclic alkyl, alkenyl, or alkynyl moiety. The term "cellulosic" refers to any fiber that has a cellulose constituent, including but not limited to cotton, linen, rayon, acetate, and triacetate.

The invention as disclosed includes permanently stain resistant polyamide and cellulosic fibers, and a method to impart permanent stain resistance to polyamide or cellulosic fibers, by covalently binding a stain resistant composition to a linking compound that has been covalently attached to the fiber. Alternatively, the linking compound can be attached to the stain resistant composition and then linked t the fiber. This invention represents a significant advance in the art of textile treatments in that the covalently linked stain resist treatment is not removed after a series of alkaline shampooings. This invention is particularly useful in the preparation of commercial grade carpets for heavy traffic areas that will not lose their stain resistance after frequent shampooing.

Fiber reactive dyestuffs containing a fiber-reactive end and a chromophore, such as an azo dye, have been used extensively to covalently attach the chromophore to the fiber. Examples of this technology are described in BP 1,428,382 to Imperial Chemical Industries, EP 0,089,923 and BP 1,542,773 to Ciba Geigy, A.G., BP 1,473,062 to Imperial Chemical Industries, DE Appl. 3,433,983 filed by Hoesct, A.G., and European Patent Appl. EP 302,013 filed by Ciba-Geigy, A. G.. Fiber reactive compounds have also been used to increase the affinity of a polyamide fiber for basic dyestuffs (for example, see U.S. Pat. No. 3,622,543). A method for treating textile fibers to enhance their affinity for disperse dyestuffs (dyes that are dispersed in the fiber as opposed to covalently attached to the fiber) by treating a fiber with a fiber reactive compound is described in European Patent Application Nos. 84300543.8 and 8303850 filed by the Wool Development International Limited. None of these references, however, disclose a method to render fibers permanently stain resistant by covalently linking the fiber to a fiber reactive compound that is then covalently linked to a stain resist agent that ionically or covalently blocks remaining "dyeable" functional groups on the fiber.

The stain resistant treatment can be applied to dyed or undyed fibers, either alone or in combination with a soil and water resistant fluorochemical. The fluorochemical can be applied to the fiber either before or after the stain resist treatment, but is preferably added after stain treatment.

I. NATURE OF FIBER

Fibers that can be made permanently stain resistant using the method disclosed here are those that have functional groups that can displace or react with the X moiety of X-A-Y to form a covalent bond between the fiber and A-Y. Fibers with terminal amino groups, such as polyamides, are suitable because they can displace a number of functional groups, and particularly chlorine groups, from heterocyclic and aromatic compounds under basic conditions. Polyamide fibers with terminal amine groups include nylon, wool, and silk. Polyamides also have terminal carboxyl groups that can be covalently bound through a linking agent to a stain resistant composition.

Fibers that have free hydroxyl groups can also react with an X-A-Y structure to form a covalent bond with A-Y or X-A-Y. For example, all cellulosic fibers, including rayon, that contain free hydroxyl groups can be made permanently stain resistant using this procedure. Polyester fibers also contain terminal hydroxyl groups that can react with X-A-Y to form covalent linkages.

II. STAIN RESISTANT COMPOSITIONS THAT CAN BE COVALENTLY BOUND TO THE FIBER THROUGH A LINKING AGENT

The term "stain resistant composition or stain resistant treatment" as used herein refers to any treatment or composition that imparts stain resistance to fibers, particularly polyamide or cellulosic fibers.

There are a number of known and commercially available stain resistant compositions for nylon fibers that bind to the fiber through ionic salt linkages, including a broad range of sulfonated aromatic formaldehyde condensation polymers (novolac resins), polymethacrylic acid or copolymers of polymethacrylic acid, and reacted products of the polymerization of $\alpha$-substituted acrylic acids in the presence of novoloid resins. Preferred $\alpha$-substituents include a hydrocarbon, halogenated hydrocarbon, or sulfonated hydrocarbon of from $C_1$ to $C_{20}$, phenol, naphthol, sulfonated phenol, sulfonated naphthol or a halogen. Any of these stain resist products can be covalently bound to the fiber through a linking agent. For superior stain resistance, it is preferred that a stain resist treatment be used that contains at least some sulfonated aromatic formaldehyde condensation polymer, either free or as part of a larger polymer. Preferred stain resist compositions are described in U.S. Pat. No. 4,940,757 to Moss, et al., U.S.S.N. 07/457,348 (filed on Dec. 27, 1989 by Moss, et al., now U.S. Pat. No. 5,061,763), and U.S.S.N. 07/521,752 (filed on May 10,1990 by Moss, et al., now U.S. Pat. No. 5,015,259), all of which are incorporated herein by reference in their entirety. A particularly preferred composition is prepared using the procedure described in Example 1.

EXAMPLE 1

Preparation of Composition containing the Reaction Product of Methacrylic Acid and Formaldehyde Condensation Copolyme of 2,4-Dimethylbenzenesulfonic Acid and 4,4'-Sulfonylbis(phenol).

Glacial methacrylic acid (99% in water, 18 grams), water (37 grams), sodium formaldehyde condensation copolymer of 2,4-dimethylbenzenesulfonic acid and 4,4'-sulfonylbis(phenol) (18 grams, 29% solids), ammonium persulfate (4 grams), sodium xylene sulfonate (18 grams, 40% solids) and xylene sulfonic acid (5 grams, 90% solids) are placed in a 2 liter round bottom flask equipped with a mechanical stirrer, reflux condenser, thermometer, and water bath (in the order water, sodium xylene sulfonate, condensation polymer, xylene sulfonic acid, methacrylic acid, and then ammonium persulfate). The solution is heated to 65° C. with stirring. A large exothermic reaction rapidly raises the temperature of the reaction mixture to 100° C. The temperature was maintained at 90°-100° C. for 30 minutes. The resulting viscous solution was diluted with 55 to 58 grams of water to give a final total solids concentration of 38 to 39 weight percent.

III. DESCRIPTION OF THE LINKING COMPOUND (X-A-Y)

The linking compound is a colorless compound With the structure X-A-Y, wherein X is a group that is easily displaced by or reacts with a reactive group on the fiber to form a covalent linkage between A or X and the fiber, Y is or contains a functional group that will covalently link to a stain resistant treatment, or is displaced by a functional group on the stain resist treatment, and A is an aromatic, heteroaromatic, or aliphatic moiety that optionally contains side groups other than X or Y that may or may not react with the fiber or the stain resist treatment.

In a preferred embodiment, the X and Y components have distinct affinities for the fiber and stain resistant composition, respectively, and do not significantly enter into unproductive reactions with other functional moieties.

A COMPONENT

It is preferred to use a moiety for the A component that is well suited to nucleophilic displacement reactions. For example, aromatic heterocyclic compounds that contain nitrogen atoms in the ring are electron deficient and easily participates in nucleophilic aromatic substitution reactions in which an electron withdrawing group (X) on the heteroaromatic ring is displaced by an attacking nucleophile (the amine group on the polyamide or hydroxyl group of a cellulosic) under basic conditions. Examples of suitable heterocycles include triazine, pyrimidine, quinoline, isoquinoline, pyridazine, pyrazine, cinnoline, phthalazine, quinazoline, and quinoxaline. Aromatic structures that do not contain electron withdrawing heteroatoms in the ring are significantly less active in nucleophilic displacement reactions, but may react under proper conditions that are known to those skilled in the art. Electron withdrawing groups on the ring in addition to X, such as nitro, cyano, quaternary amine, carboxyl, sulfonyl, acyl, and aldehyde, greatly enhance the activity of an aromatic or heteroaromatic ring toward nucleophilic displacement reactions. Aliphatic structures can also participate in nucleophilic substitution or addition reactions under the proper conditions. For example, alkyl halides react with primary amines (from polyamides) and hydroxyl groups (from cellulosics) to form alkyl amines and ethers, respectively. The reaction of an alkyl halide with a primary amine occurs under moderate conditions, however, the reaction of an alkyl halide with a hydroxyl group requires more strenuous conditions, and is less preferred as a route to the formation of a covalent bond between the linking compound and the fiber. a-Haloacyl compounds can also be reacted with a polyamide or a cellulosic to form a covalently bound material.

In another embodiment, a linking compound of the structure $YSO_2CH_2CH_2OSO_2H$ or $YSO_2CH_2CH_2X$, wherein X is a halogen, preferably chlorine, can be used to covalently bind the fiber to the stain resist agent. Under alkaline conditions, these compounds are converted to the corresponding vinyl sulfone, $YSO_2CH{=}CH_2$, that will react with a cellulosic hydroxyl group or an amine on a polyamide to produce a structure in which the hydroxyl group or the amine is covalently linked with the terminal $CH_2$ ($YSO_2CH_2CH_2OR$ or $YSO_2CH_2CH_2NHR$). When carrying out this reaction, it is preferred to allow initial absorption of the vinyl sulfone precursor into the fiber and then raise the pH of the bath with sodium hydroxide, salt, and soda ash or trisodium phosphate to produce the vinyl sulfone that reacts with the fiber. In a preferred embodiment, wool is treated for stain resistance by treating it with the vinyl sulfone precursor, anhydrous Glauber's salt, and sulfuric acid. The fiber is then heated until the reaction is complete.

Acrylamides of the structure $YNHCOCH{=}CH_2$, or their precursor compounds, $YNHCOCH_2CH_2OSO_2H$, are likewise useful to link a fiber to a stain resist treatment, and can be applied under the conditions similar to those used for vinyl sulfones.

X COMPONENT

An X component can be chosen that is easily displaced by or reacts with the functional group on the polyamide (a terminal amine or a carboxylic acid group) or cellulose (a hydroxyl group) under the conditions of application. Amines are typically more reactive under basic conditions, and tend to displace electron withdrawing groups on aromatic, heteroaromatic, or aliphatic moieties. Examples of suitable X components include chlorine, bromine, nitro, and α-halo acyl groups. Carboxylic acid groups react with a variety of substrates to form acid derivatives such as anhydrides, amides, and esters.

The reactivity of a halogen, particularly chlorine, in a triazine, is substantially affected by the other substituents on the triazine ring. For example, the chlorines of a trichlorotriazine will react with a terminal amine group of a polyamide or hydrogen of a cellulosic at room temperature, and a chlorine in a dichlorotriazine may react with a terminal amine or cellulosic hydrogen at room temperature if a base is present. However, the chlorine in a monochlorotriazine will only react when heated under alkaline conditions. Chlorine atoms in triazines will react with cellulosic hydroxyl groups faster than they react with water.

Y COMPONENT

The Y component is or contains a moiety that can covalently bind with, or be displaced by, a functional group on the stain resist polymer. For example, when using a stain resist composition that includes a novoloid resin containing aromatic hydroxyl groups (phenols), a Y component should be selected that will easily react with the phenol under the conditions of application, including, for example, sulfonic acids or salts, carboxylic acids or salts, phosphoric acids or salts, alkyl halides, acyl halides, sulfonyl halides, 2, 3, or 4-sulfoanilino, 2,4- or 2,5-disulfoanilino, 6or 7-sulfonapth-2-yl-amino, 4-, 5-, or 7-sulfonapth-1-ylamino, 3,6-disulfonaphth-1-yl-amino-, 3,6,8-trisulfonapth-1-ylamino, 5-carboxy-2-sulfoanilino, or sulfoethylthiosulfat Alternatively, a Y component can be chosen that reacts with sulfonic acid groups on the sulfonated formaldehyde condensation polymer, such as amines, and hydroxylated moieties.

If polymethacrylic acid or a copolymer of methacrylic acid is used as the stain resist agent, then a Y component should be chosen that will covalently bind to the carboxylic acid functional groups under the conditions of application, including, but not limited to, alcohols, phenols, napthols, or amines.

Given the description of the invention herein, one of ordinary skill in the art of organic synthesis will recognize the functional groups on the stain resistant composition of choice, and will easily be able to select functional Y moieties that covalently link with the functional groups in the stain resistant composition. All of these combinations are considered within the scope of this invention.

EXAMPLES OF SUITABLE LINKING COMPOUNDS

Given the above guidelines on how to select appropriate moieties for A, X, and Y, one of ordinary skill in organic synthesis will be able to prepare suitable linking agents that will covalently bind with the fiber and stain resist treatment under the conditions of application. A number of appropriate compounds are commercially available. Methods of preparation of the other compounds are available from standard literature sources or can be prepared without undue experimentation from literature methods for the preparation of similar compounds.

Nonlimiting examples of suitable linking compounds (X-A-Y) include benzenesulfonic acid, 4-[[4-chloro-6-(1-methylethoxy)1,3,5-triazin-2-yl-amino]-monosodium salt (a preferred linking agent); 2,4-dichloro-s-triazin-6-yl-aminobenzene; 2,4-dichloro-6-(*o,m,* or *p*-sulfonylanilino)-s-triazine; 2',5'-disulfoaniline)-*s*-triazine, 2,4-dihydroxy-6-(*o,m,*or p-sulfonylanilino)-s-triazine, dichloro-6-6-yl-amino)-4-butylbenzene;2-chloro-4,6-di-(*p*-sulfonyl)anilino-*s*-triazine; 2,4-dichloro-6-(*p*-sulfonyl-)anilino-*s*-triazine; 1-(2,4-dichloro-*s*-triazin-6-yl-amino)-4-do chloro-4-anilino-*s*-triazin-6-yl)-amino benzene-4'-sulfato ethyl sulfone; disodium-2,4-(amino benzene-4'-sulfato ethyl sulfone)

otriazine; 2,6-diphenoxy-4-(*m*-sulfoanilino)-pyrimidine, 4,6chlor diphenoxy-2-(*m*-sulfoanilino)-pyrimidine, 2,6-diphenoxy-4-(*m*-sulfoanilino)-5-cyanopyrimidine,4,6-diphenoxy-2-(*m*-sulfoanilino)-pyrimidine, 2,4,6-trichloropyrimidine, 2,4,6-trichlorotriazine (cyanuric chloride), 2,4-bis[4-(chloroformyl)-phenyl]-6-phenoxy1,3,5-triazine, 2-chloro-4,6-diphenoxy-triazine, and 2,4-diamino6-halo-*s*-triazine, 2-phenoxy-4,6-bis-(4'-carboxyphenyl)-*s*-triazine, dichlorotriazine, dichloroquinoxaline, monofluoro-monochlorotriazine, and difluoro-mono-chloro-pyrimidine.

IV. PREPARATION OF PERMANENTLY STAIN RESISTANT FIBERS

In a preferred embodiment, the fiber is initially reacted with the linking compound in an aqueous solution at elevated temperature at the appropriate pH (typically under basic conditions) for the minimum time period and at the minimun temperature sufficient to covalently bind the linking compound to the fiber. It is important that the reaction time be minimized so that the fiber reactive groups (X) are not hydrolysed before they can react with the fiber. To increase the absorption of the linking compound before it reacts with the fiber, the compound can be exhausted onto the fiber at low pH and high temperature, and after sufficient exhaustion has taken place, the pH raised to facilitate reaction (or exhausted at high pH and then reacted at low pH if appropriate). The pH can be raised with any suitable basic compound, including sodium hydroxide, potassium hydroxide, sodium carbonate, ammonium hydroxide, or amines such as monoethylamine, diethylamine, or triethylamine. In a preferred embodiment, a common salt is added to increase exhaustivity of the linking agent onto the fiber. Appropriate salts include sodium chloride, potassium chloride, and sodium sulfate.

Any industrial method of application is appropriate that results in covalent bonding of the linking agent with the fiber. In one embodiment, a linking agent that reacts with the fiber under basic conditions is applied to the fiber at the pH that facilitates reaction (typically approximately 8 to 10) at a temperature of 100 to 350° F. for 3 to 15 minutes in an exhaust bath, dye beck, or steamer. Alternatively, the linking agent can be foamed, sprayed, or padded onto the fiber, and then passed through a drying oven. Any appropriate amount of linking compound can be applied to the fiber, typically from 0.001 to 30% by weight on the weight of the fiber (owf). The linking agent can be dissolved or dispersed in water in the presence of a cosolvent or nonionic surfactant. Solvents such as alcohol or surfactants can be used to wet the fiber to allow better penetration of the linking compound into the fiber. Suitable surfactants are well known to those of skill in the art of textile applications, and include ethoxylated nonylphenols and decyl alcohols. Natural gums, such as xanthans, guar gums, or other thickeners such as sodium alginate can also be added to the application solution. Swelling agents such as urea can also be added. If the linking agent is fixed in an exhaust bath or by aqueous steam, the fiber can be washed to remove resulting undesired residues before applying the stain resistant composition.

In an alternative embodiment, the linking compound can be covalently bound to the stain resist composition and then linked with the fiber as described above.

In the second step of the treatment, the fiber-A-Y is contacted with a solution of the stain resistant composition under conditions appropriate to facilitate the formation of a covalent linkage between the linking agent and the stain resistant composition. In one embodiment, the stain resistant composition is applied to the fiber with linking agent at acidic pH. The pH can be adjusted with any of the agents normally used for this purpose during textile applications, including sulfamic acid, hydrochloric acid, methacrylic acid, acrylic acid, polymethacrylic acid, polyacrylic acid, copolymers of methacrylic or acrylic acid, formic acid, acetic acid, phosphoric acid, or xylene sulfonic acid. Any amount of stain resistant composition can be applied that results in desired stain performance. In one embodiment, between approximately 1 and 6% of stain resistant composition on the weight of the fiber is applied to the fiber. The stain resistant composition can be applied under the same conditions described above for application of the linking agent, or can be applied by other means known to those in the art of textile applications. In a preferred embodiment, the composition is applied to the fiber and heated at a temperature ranging from 100° to 350° F. for from approximately 10 seconds to 10 minutes. Solvents, surfactants, thickeners, gums, salts, including metal salts, and other desired components can be added to the application formulation.

It is preferred that the fiber be completely dried after it has been heated with the stain resistant composition, to insure that the composition is covalently bound to the linking agent.

EXAMPLE 2

Preparation of Permanently Stain Resistant Nylon Fibers

Solution A was prepared by mixing 408 ml of water, 20 ml (20%) of benzenesulfonic acid, 4-[[4-chloro-6-(1-methylethoxy)-1,3,5 -triazin -2-yl-amino]-monosodium salt, sodium chloride (57 grams), soda ash (15 grams), sodium alginate Kelco XL solution (2%, 500 ml) to form a solution of pH 9.57. Solution B was prepared by mixing 8 ml of the product of Example 1 (32% solids), 488.5 ml of water, and 3.5 ml of sulfamic acid to produce a solution of pH below 1.0.

BASF Corporation solution dyed nylon 6 type 1018 contract fiber (25 gram) was prescoured with a solution of Nacanol 90G (sodium salt of dodecylbenzenesulfonic acid) and sodium cumeme sulfonate. The carpet was then rinsed, and two times the weight of the carpet of solution A (50 ml) was applied to the carpet fibers. The carpet was heated in a microwave oven for 4 minutes, and then rinsed in cold water.

Four times the carpet weight (100 ml) of Solution B was then applied to the fiber and the carpet strip again placed in a microwave oven for 4 minutes. The carpet was then completely dried to a crisp feel.

EXAMPLE 3

Preparation of Permanently Stain Resistant Cotton Fibers

The procedure described in Example 2 is repeated using cotton fibers.

EXAMPLE 4

Stain Resistance of Nylon Fibers Treated as in Example 2

Nylon carpet fibers treated as in Example 2 were shampooed 4 times with a solution of Tide TM powder detergent. The fibers were then subjected to chlorine bleach, coffee, red wine, mustard, Heinz 57 TM sauce, and Cherry Kool-aid for 24 hours. None of these materials discolored the fiber as measured by the AATCC gray scale (0–5, with 0 indicative of no staining).

EXAMPLE 5

Large Scale Treatment of Cotton Fabric for Permanent Stain Resistance

Dyed cotton fabric is sprayed, dipped, or padded to saturation with Solution A as prepared in Example 2, and then heated at 240° F. to dryness. The fabric is then submerged in Solution B prepared as in Example 2, steamed, washed, and dried.

EXAMPLE 6

Large Scale Treatment of Nylon Fabric for Permanent Stain Resistance

Nylon solution dyed fabric (10 grams) is sprayed, dipped, or padded to saturation with Solution A as prepared in Example 2, with the inclusion of sodium chloride (57 grams/liter), and sodium alginate (500 ml of 2% solution per liter of application solution), and then steamed at 212° F. to dryness. The fabric is then washed and saturated with Solution B prepared as in Example 2, washed, and dried.

V. Fluorochemical Coating

Fluorochemical coatings are known that prevent wetting of the carpet surface, by minimizing chemical contact between the carpet surface and substances that can stain the carpet, making the substance easier to remove. Fluorochemicals also provide a physical barrier to staining material.

Examples of commercially available fluorochemical coatings include Scotchgard TM 358 and 352 (Minnesota Mining & Mfg. Co.) and Zonyl TM 5180 Fluorochemical dispersion, and Teflon Tuft Coat Anionic, both manufactured by E.I. Du Pont de Nemours and Company, Inc. Zonyl TM 5180 is an aqueous fluorochemical dispersion containing a 1–10% polyfunctional perfluoroalkyl ester mixture, 10–20% polymethylmethacrylate, and 70–75% water. Teflon Tuftcoat Anionic contains 5–10% perfluoroalkyl substituted urethanes, 1–5% polyfunctional perfluoroalkyl esters, and 85–90% water.

A fluorochemical coating such as those described above can be added to the permanently stain resistant fiber to decrease wetting of the fiber and to decrease soiling. The fluorochemical can be applied to the fiber by any means known to those skilled in the art of textile applications, including by spray, exhaust, or foam. The fluorochemical is applied at any desired amount, typically between 0.01 and 5% on the weight of the fiber. As an example, a solution of 8 to 10% fluorochemical can be sprayed on the fiber at 10 to 20% weight add on to provide 1.0 to 2.0% fluorochemical on the weight of the fiber.

In an alternative embodiment, the fluorochemical can be mixed and applied together with the stain resistant agent.

Modifications and variations of the present invention, permanently stain resistant fibers and their method of manufacture, will be obvious to those skilled in the art from the foregoing detailed description. Such modifications and variations are intended to come within the scope of the appended claims.

We claim:

1. A permanently stain resistant fibrous material comprising a fiber of the structure fiber-A-$(Y)_n$-S, wherein:

A is an aromatic moiety that contains an electron withdrawing group other than Y, or a heteroaromatic moiety that optionally contains side groups other than Y;

Y is or contains a functional group that is covalently linked to a stain resistant material;

S is a stain resistant material that comprises a substance selected from the group consisting of a sulfonated formaldehyde condensation polymer or copolymer, polymethacrylic acid, a copolymer of methacrylic acid, and a product prepared by reacting an α-substituted acrylic acid in the presence of a novoloid resin, wherein the α-substitutent is a hydrocarbon, halogenated hydrocarbon, or sulfonated hydrocarbon of from $C_1$ to $C_{20}$, phenol, napthol, sulfonated phenol, sulfonated napthol, or halogen;

the fiber has a terminal amino, carboxyl, or hydroxyl group; and n is 0 or 1.

2. The permanently stain resistant fibrous material of claim 1, wherein A is a heteroaromatic moiety formed from a precursor that will participate in a nucleophilic displacement reaction.

3. The permanently stain resistant fibrous material of claim 1, wherein A comprises a moiety selected from the group consisting of triazine, pyrimidine, quinoline, isoquinoline, pyridazine, cinnoline, phthalazine, quinazoline, and quinoxaline.

4. The permanently stain resistant fibrous material of claim 1, wherein Y comprises a moiety selected from the group consisting of a sulfonic acid or salt, carboxylic acid or salt, phosphoric acid or salt, alkyl halide, acyl halide, sulfonyl halide, 2, 3, or 4-sulfoanilino, 2,4- or 2,5-disulfoanilino, 6- or 7-sulfonapth-2 -yl-amino, 4-, 5-, or 7-sulfonapth-1-ylamino, 3,6-disulfonaphth-1 -yl-amino-, 3,6,8-trisulfonapth-1ylamino, 5-carboxy-2-sulfoanilino, or sulfoethylthiosulfate.

5. The permanently stain resistant fibrous material of claim 1, wherein the fiber is selected from the group consisting of polyamides and celluosics.

6. The permanently stain resistant fibrous material of claim 1, wherein the fiber is selected from the group consisting of nylon, silk, and wool.

7. The permanently stain resistant fibrous material of claim 1, wherein the fiber is cotton.

8. The permanently stan resistant fibrous material of claim 1, wherein the fiber is rayon.

* * * * *